US010227870B2

(12) United States Patent
Lehnert et al.

(10) Patent No.: US 10,227,870 B2
(45) Date of Patent: Mar. 12, 2019

(54) CHISEL

(71) Applicants: Betek GmbH & Co. KG, Aichhalden (DE); Wirtgen GmbH, Windhagen (DE)

(72) Inventors: Thomas Lehnert, Oberraden (DE); Karsten Buhr, Willroth (DE); Cyrus Barimani, Königswinter (DE); Heiko Friederichs, Aichhalden (DE); Karl Kammerer, Fluorn-Winzeln (DE); Markus Roth, Aichhalden (DE)

(73) Assignees: Betek GmbH & Co. KG (DE); Wirtgen GmbH (DE)

( * ) Notice: Subject to any disclaimer, the term of this patent is extended or adjusted under 35 U.S.C. 154(b) by 16 days.

(21) Appl. No.: 15/023,718

(22) PCT Filed: Sep. 1, 2014

(86) PCT No.: PCT/EP2014/068499
§ 371 (c)(1),
(2) Date: Mar. 22, 2016

(87) PCT Pub. No.: WO2015/043884
PCT Pub. Date: Apr. 2, 2015

(65) Prior Publication Data

US 2016/0230551 A1 Aug. 11, 2016

(30) Foreign Application Priority Data

Sep. 26, 2013 (DE) ..... 10 2013 110 676

(51) Int. Cl.
*E21C 35/19* (2006.01)
*E21C 35/18* (2006.01)
*B28D 1/18* (2006.01)

(52) U.S. Cl.
CPC ..... *E21C 35/18* (2013.01); *B28D 1/186* (2013.01); *E21C 35/19* (2013.01)

(58) Field of Classification Search
CPC ..... E21C 35/18; E21C 2035/1803; E21C 2035/1806; E21C 2035/1826;
(Continued)

(56) References Cited

U.S. PATENT DOCUMENTS 4,240,669 A 12/1980 Rollins
4,921,310 A * 5/1990 Hedlund ..... E21C 35/197 299/107
(Continued)

FOREIGN PATENT DOCUMENTS

DE 3644169 A1 * 7/1988
DE 202007018885 * 10/2009

OTHER PUBLICATIONS

Co-pending U.S. Appl. No. 15/023,717, filed Mar. 22, 2016. (not prior art).

*Primary Examiner* — Sunil Singh
(74) *Attorney, Agent, or Firm* — Lucian Wayne Beavers; Patterson Intellectual Property Law, PC

(57) ABSTRACT

The invention relates to a chisel (10) having a chisel head (11) and a chisel shaft (17), wherein near its end facing away from the chisel head the chisel shaft has a threaded portion having a thread (19), wherein the chisel head holds a chisel tip (20) made of a hard material, and wherein near the side facing the chisel shaft the chisel head is provided with a supporting surface (15). Especially when superhard hard materials are used for the chisel tip, a load-optimized chisel design is obtained by a domed supporting surface (15).

19 Claims, 13 Drawing Sheets

(58) Field of Classification Search
CPC ..... E21C 35/183; E21C 35/19; E21C 35/193; E21C 35/1933; E21C 35/1936; E21C 35/197
USPC ..... 299/79.1, 81.3, 100–111, 112 R, 112 T, 299/113; 144/24.12, 334; 411/369, 166, 411/435, 409, 402
See application file for complete search history.

(56) References Cited

U.S. PATENT DOCUMENTS

| | | | | |
|---|---|---|---|---|
| 5,007,685 | A * | 4/1991 | Beach | E21C 35/1933 299/103 |
| 5,319,854 | A * | 6/1994 | Pracht | B26B 13/28 30/194 |
| 6,321,623 | B1 * | 11/2001 | Dykes | B25B 13/065 411/402 |
| 6,712,431 | B1 * | 3/2004 | Bosch | E21C 35/197 299/104 |
| 6,832,882 | B2 * | 12/2004 | Janisch, Jr. | F16B 33/00 411/366.3 |
| 2008/0142116 | A1 * | 6/2008 | Green | A01G 23/067 144/24.12 |
| 2008/0223744 | A1 | 9/2008 | Tewes et al. | |
| 2010/0181820 | A1 * | 7/2010 | Latham | B28D 1/188 299/111 |
| 2011/0148179 | A1 | 6/2011 | Lehnert et al. | |
| 2012/0025591 | A1 * | 2/2012 | Fader | E01C 23/082 299/106 |
| 2012/0080930 | A1 | 4/2012 | Latham | |
| 2012/0104833 | A1 * | 5/2012 | Latham | B28D 1/188 299/104 |
| 2012/0272552 | A1 | 11/2012 | Tack | |
| 2014/0117741 | A1 | 5/2014 | Lehnert et al. | |

* cited by examiner

CHISEL

FIELD

The invention relates to a chisel having a chisel head and a chisel shaft, wherein the chisel shaft has in the region of the end thereof facing away from the chisel head a thread portion having a thread, wherein the chisel head carries a chisel tip comprising a hard material and wherein the chisel head is provided with a support face in the region of the side facing the chisel shaft.

BACKGROUND

Such cutting chisels are generally used on cutting rollers of ground processing machines, in particular road construction machines, mining machines or the like.

The cutting rollers of road milling machines, mining machines or the like are usually provided with chisel holder changing systems. In this instance, base portions of the chisel holder changing systems can be connected to the surface of a cutting roller pipe, in particular welded or screwed thereto. In this instance, the base portions are positioned relative to each other so that helical loading members are produced on the surface of the cutting roller. Chisel holders are connected to the base portions, wherein the chisel holders may be screwed, welded or otherwise retained with respect to the base portion, for example, clamped. In the simplest case, the chisel holders may also be directly connected to the surface of a cutting roller pipe. The chisel holders have a chisel receiving member. The chisels described above can be mounted therein so as to be able to be replaced. During use of the machine, the chisels strike with the chisel tips thereof the substrate which is intended to be removed and cut into it. In this instance, the ground material is broken up. The material which has been removed in this manner can be transported, for example, via the helical broaching and loading members toward the center of the cutting roller and conveyed out of the operating region of the cutting roller at that location by means of ejectors. The material can then be transported away using appropriate devices, for example, transport belts. The chisels are provided with chisel tips, which comprise hard material and which bring about the cutting engagement. They are consequently subjected to an abrasive attack and must therefore comprise a suitable hard material in order to achieve the longest possible service-life. From the prior art there are known chisels in which the chisel tip comprises hard metal. In order to be able to generate uniform wear at the periphery with such chisels, the chisels are generally rotatably arranged in chisel receiving members of the chisel holders.

There are also known chisels which are provided in the region of the chisel tips thereof with a "superhard material". For example, the chisel tips have a coating of polycrystalline diamond or another material which has a hardness which is comparable with diamond. Such a chisel is known from US 2012/0080930 A1. Such chisel tips have an extraordinarily long service-life and exhibit hardly any wear during operational use. It is therefore not absolutely necessary to fix these chisels in a rotatable manner in the chisel holders. US 2012/0080930 A1 therefore proposes providing the chisel shaft of the chisel with a thread and clamping the chisel securely to the chisel holder by means of a nut. If after a specific operating time wear appears on the chisel, the nut can be released, the chisel can be rotated slightly and the nut can then be retightened.

The chisel is supported with a support portion of the chisel head on a correspondingly formed counter-face of the chisel holder. In this instance, the support portion is constructed in a frustoconical manner and tapers from the chisel head in the direction toward the chisel shaft. During the cutting engagement of the chisel, the cutting force which acts on the chisel varies not only with regard to the value thereof, but also with regard to the force direction. In this instance, it may be the case inter alia that stresses which act in an impact-like manner act on the chisel in the case of uneven surface quality. Those loading situations may result in the support face of the chisel or the corresponding counter-face of the chisel holder being deflected and then the thread connection between the chisel and the chisel holder becoming loose. The chisel can then break or become lost.

BRIEF SUMMARY

An object of the invention is to provide a chisel of the type mentioned in the introduction with which an improved operational reliability and service-life can be achieved.

This object is achieved in that the support face of the chisel head is curved.

The curvature of the support face allows an increased surface with respect to a frustoconical construction for the same construction space. This results in smaller surface pressures and therefore in a construction method which is optimized in terms of loading. Furthermore, in conjunction with a counter-face of the chisel holder, which counter-face is curved in accordance with the support face, a type of "ball-and-socket joint" can be constructed. Such a bearing can react particularly well to the changing force directions which occur during the cutting process and can discharge those forces uniformly and reliably into the chisel holder. Tension peaks which occur in particular in the case of impact-like loads are thereby minimized. The term "curved" is intended to be understood according to the invention to be support face geometries in which the support face is constructed to be spherically convex or correspondingly concave, in particular constructed to be spherical, ellipsoid-like, etc. Spherical or ellipsoid-like geometries can be readily produced and in particular allow the above-mentioned ball-and-socket type construction.

According to a preferred construction variant of the invention, there may be provision for the chisel head to have a tool receiving member. By means of this tool receiving member, the chisel can be gripped from the front chisel side with a screwing tool and screwed to the chisel holder. The chisel is readily accessible in the region of the chisel head and has a diameter which is greater than the chisel shaft. In this instance, the tool receiving member can then also be constructed with a large effective cross-section in order to be able to better introduce the necessary tightening torques for clamping the chisel.

In a particularly preferable manner, the tool receiving member is constructed as an outer polygonal member, in particular as an outer hexagonal member, so that screwing is possible with conventional fixing tools. It is also conceivable for one or more recesses which act as tool receiving members to be formed round the chisel head, such as, for example, bores. They can be orientated substantially axially, that is to say, therefore, parallel with the longitudinal center axis of the chisel according to the invention or substantially radially, that is to say, therefore, orthogonally to the longitudinal center axis. Tools can then be inserted therein and a rotation of the chisel brought about. An advantageous aspect of a through-hole in a radial direction is the fact that the tool receiving member is also retained when the chisel head is worn to a very great extent.

A preferred variant of the invention is such that a concave discharge face of the chisel head directly or indirectly adjoins the tool receiving member and is arranged in the region between the chisel tip and the tool receiving member. The discharge face discharges the ground material which is substantially cut away by the chisel tip away from the tool receiving member and therefore prevents or at least reduces the wear in the region of the tool receiving member. In this regard, the discharge face forms a type of deflector.

In that the discharge face discharges the cut material outward, wear to the chisel holder is also prevented.

In a particularly preferred manner, there may also be provision for the maximum cross-section, in particular the diameter, of the chisel head to be greater than the cross-sectional region of the chisel holder adjoining the chisel head in order to protect it from wear.

In order to be able to bring about a chisel construction which is as compact as possible, there may be provision for a receiving member in which the chisel tip is inserted to be formed in the region of the chisel head forming the discharge face.

The chisel tip preferably has an operating portion which is formed from a superhard material. Such a material may be formed from a material which has a similar hardness to diamond. It is particularly conceivable to use polycrystalline diamond, natural diamond, synthetic diamond, vapor-deposition diamond, silicon-bonded diamond, cobalt-bonded diamond, thermally stable diamond, cubic boron nitride, a diamond-infiltrated material, a diamond-tipped matrix, a diamond-impregnated carbide or a similar material. This is not a conclusive listing and it is clear to the person skilled in the art that the advantages of the present invention are produced with a large number of different chisel tips and the materials used therein.

A particularly preferred variant of the invention is such that the chisel shaft has an expansion portion in the region between the thread and the chisel head. That expansion portion is used to form relatively high resilient deformations during the tensioning of the chisel by means of the thread thereof and accordingly a pretension in the chisel shaft. Accordingly, the expansion portion acts as a type of spring. If the chisel strikes the hard substrate to be processed, as a result of the tension direction the pretensioning force is relieved and a residual clamping force is produced. The resilient deformation in the expansion portion ensures that the residual clamping force is not completely eliminated. If the chisel is then out of engagement with the ground again, the pretension in the expansion portion is again produced. The thread connection of the chisel is thereby prevented from becoming loose even in the event of impact-like loads. Furthermore, the resilient deformation in the expansion portion ensures that an adequate pretension and therefore also a residual clamping force is maintained in spite of the unavoidable setting losses. A durably reliable chisel fixing action is thereby achieved. This is particularly advantageous during the use of the above-mentioned superhard materials and the associated high running times of the chisels.

In order to be able to form a sufficiently effective expansion portion in this instance with conventional road milling applications, the expansion portion is intended to extend at least 20 mm and a maximum of 50 mm in the direction of the longitudinal center axis of the chisel shaft.

The expansion portion may have a portion with uniform cross-section, in particular a cylindrical cross-section and/or a cross-section which changes in the direction of the longitudinal center axis of the chisel shaft. In the case of changing cross-sections, the expansion rate of the expansion portion can be adjusted in a selective manner.

A preferred variant of the invention is such that the shaft cross-section does not taper from the chisel head in the direction toward the thread portion and the thread portion does not have a substantially smaller diameter than the transition region which is formed between the chisel head and the thread portion, and such that a nut is retained on the thread. If the improbable case of a chisel breakage occurs, wherein the chisel head breaks off the chisel shaft, then the chisel shaft remaining in the chisel holder can be pulled backward out of the chisel holder with this construction.

Another variant of the invention is such that the chisel head has a peripheral recess and/or a peripheral projection in the region of the support face.

As already mentioned above, the forces acting on the chisel change during the cutting process. The curved support face of the chisel can react to those changing force directions particularly well, as explained above. The chisel is retained with the chisel shaft thereof in a chisel receiving member of the chisel holder or the like. If a particularly powerful pulse-like transverse force acts on the chisel, the axial portion thereof is discharged into the chisel holder via the support face. The radial portion instead attempts to pivot the chisel head with respect to the chisel holder; furthermore, the chisel shaft is thereby also stressed in terms of flexion. Finally, a tensile stress is also further introduced into the chisel shaft via the threaded connection. Consequently, a disadvantageous, multi-axis tension state can be produced in the region of the chisel shaft. In order to be able to achieve a configuration of the chisel which is optimized in terms of loading in this instance, there is provision according to a variant of the invention for the chisel head to have in the region of the support face a peripheral recess and/or a peripheral projection. Accordingly, a corresponding projection or a corresponding recess may be arranged in the region of the counter-face of the chisel holder. If, for example, a recess is arranged in the chisel head, a projection of the chisel holder engages therein. That engagement results in a connection geometry which allows improved discharge of forces and which reduces the tensions in the chisel shaft.

Furthermore, such a construction of a chisel makes it possible to compensate for production tolerances between the curved face of the chisel and the chisel holder. If, for example, a recess is formed in the chisel head, there are formed at both sides of the recess defined abutment regions which always ensure a sufficiently reliable surface contact between the chisel and the chisel holder. For this functionality, there does not have to be provision, for example, for a projection of the chisel holder to engage in a recess of the chisel, or, if a projection is arranged on the chisel, for that projection to engage in a recess of the chisel holder. In order to compensate for the surface tolerances, it is instead simply necessary for a recess to be provided in the chisel and/or in the chisel holder. For example, it is also conceivable for the chisel holder and/or the chisel to be constructed so as to have recesses, in which a peripheral sealing element is introduced. That peripheral sealing element, for example, a copper ring, an O-ring or the like, then prevents introduction of dirt into the region of the chisel shaft. The above-mentioned tooth arrangement in which a projection and a recess of the chisel or the chisel holder engage in each other, may also perform such a sealing action to a given extent in the form of a labyrinth-like seal.

There is provision in a particularly preferable manner for the recess and/or the projection to extend concentrically round the chisel shaft.

As already mentioned, the thread of the chisel may carry a nut. That nut may be provided with a sealing portion. That sealing portion prevents dirt from being introduced into the chisel holder in the region of the chisel shaft.

The nut preferably has a securing portion having blocking faces at the peripheral side. The securing portion adjoins with the blocking faces thereof support faces of the chisel holder and consequently forms in the peripheral direction of the thread a positive-locking fixing of the nut with respect to the chisel holder. When the chisel is tensioned, therefore, the nut does not have to be retained with a counter-tool. Furthermore, the nut is fixed to the chisel holder in a state protected from abrasive attack. A construction of the nut in a tension-optimized manner is produced when there is provision for the blocking faces to be constructed in a concave manner and preferably to merge into each other via convex transition portions. Such a geometry is further also simple to produce.

A further preferred variant of the invention may be such that the chisel is constructed as a forged component.

BRIEF DESCRIPTION OF THE DRAWINGS

The invention is explained in greater detail below with reference to embodiments illustrated in the drawings, in which.

DETAILED DESCRIPTION

Figure 1:
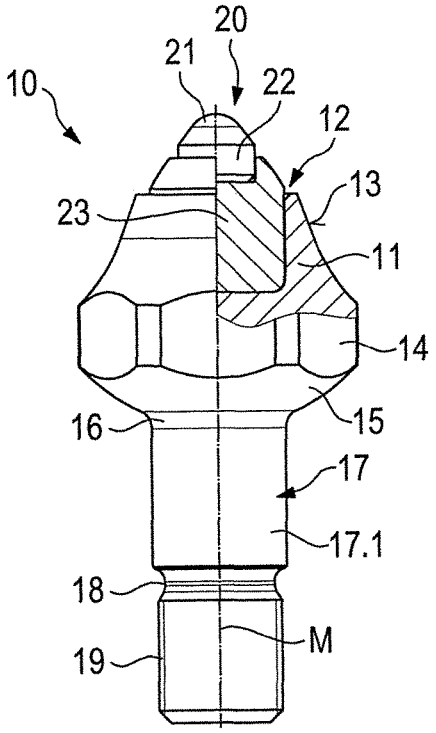
FIG. 1 is a side view and a partially sectioned view of a chisel.

FIG. 1 shows a chisel 10 having a chisel head 11 on which a chisel shaft 17 is integrally formed. The chisel head 11 has at the end thereof facing away from the chisel shaft 17 a receiving member 12 which is constructed in this instance in the form of a blind-hole-like bore. A chisel tip 20 is inserted into this receiving member 12. The chisel tip 20 has a connection portion 23 which may comprise hard metal. The connection portion 23 has at the end thereof facing away from the chisel shaft 17 a receiving member in which a carrier member 22 is inserted. The carrier member 22 comprises a hard material, for example, hard metal. It is provided at the free end thereof with a hard material coating 21. The hard material coating 21 is in this instance formed by a superhard material. In this instance, it is, for example, possible to use a material which has a similar hardness to diamond. In particular, the hard material coating 21 may comprise polycrystalline diamond. The carrier member 22 is connected to the connection portion 23 by means of a suitable connection. For example, a solder connection may be provided. The connection portion 23 may be connected to the chisel head 11 in the chisel receiving member 12 by means of a suitable connection. For example, a solder connection may be selected. The construction of the chisel tip 20, comprising the connection portion 23 and the carrier member 22 which is connected thereto with a hard material coating 21 can be produced in a simple manner. The spatially smaller carrier member 22 may be coated in a suitable coating installation with the hard material coating. The connection portion 23 of wear-resistant material is structurally larger than the carrier member 22 and therefore has a high capacity for wear.

It is also conceivable for the entire chisel tip 20 to be constructed integrally. The chisel tip could then comprise, for example, hard metal. It is further conceivable for the chisel head 11 itself to be provided with a hard material coating which forms the chisel tip and which is preferably of superhard material. The component complexity can thereby be considerably reduced.

Alternatively, it is also conceivable for the hard material coating 21 to be applied directly to the connection portion 23 with the carrier member 22 being omitted.

Alternatively, the connection portion 23 could also be constructed integrally with the carrier member 22, which would lead to a similar chisel tip, as in the preceding example, only the interface would be different.

Figure 3:
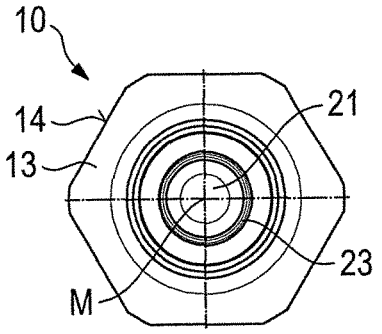
FIG. 3 is a plan view of the chisel according to FIGS. 1 and 2.
Figure 4:
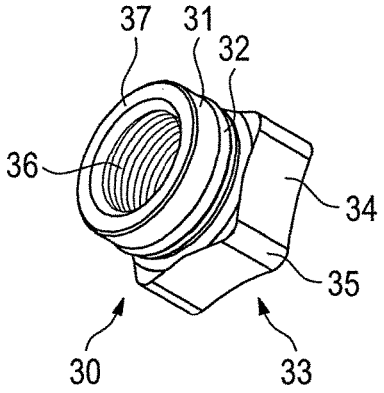
FIGS. 4 and 5 are perspective views of a nut.
Figure 5:
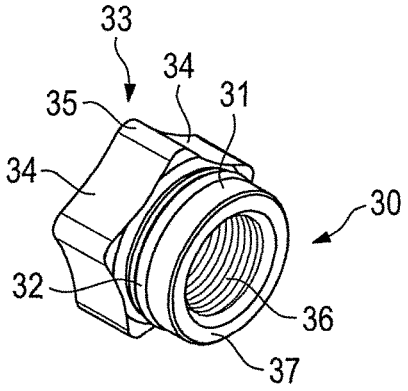

The portion of the chisel head 11 forming the receiving member 12 has a discharge face 13 which expands from the chisel tip 20 in the direction toward the shaft 17. That discharge face 13 may in particular be constructed in a concave manner, as clearly shown in FIG. 1. Adjacent to the discharge face 13, the chisel head 11 forms a tool receiving member 14. This is constructed in this instance as an external hexagonal member, as shown in FIG. 3. The external hexagonal member has a conventional wrench width for fitting a commercially available tool. Adjacent to the tool receiving member 14, the chisel head 11 forms a support face 15. The support face 15 is curved in a spherical manner. In the present embodiment, a simple-to-produce, convex ball contour is used as a spherical curvature. The chisel shaft 17 is formed centrally on the support face 15 so that the support face 15 extends in a uniform manner about the longitudinal center axis M of the chisel shaft 17. The coupling of the chisel shaft 17 to the chisel head 15 is carried out in a tension-optimized manner via a transition 16 which is formed by a rounded portion. The chisel shaft 17 has a cylindrical region, which forms an expansion portion 17.1. In the region of the free end of the chisel shaft 17, a thread 19 is cut on the chisel shaft 17. A recess 18 is provided between the thread 19 and the chisel shaft 17.

Figure 6:
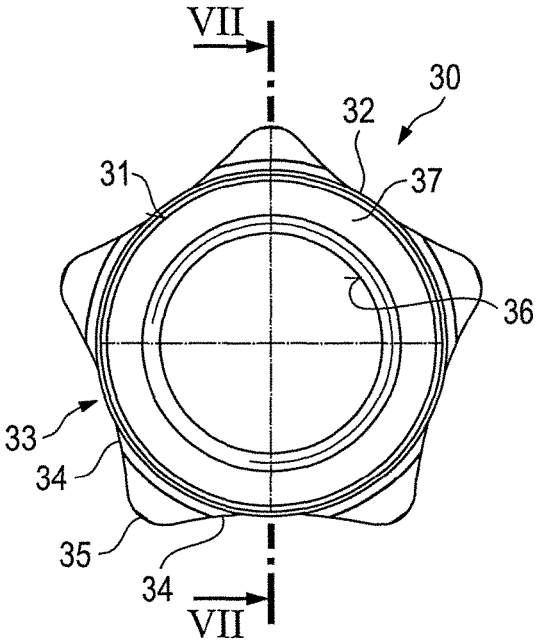
FIG. 6 is a plan view of the nut according to FIGS. 4 and 5.
Figure 7:
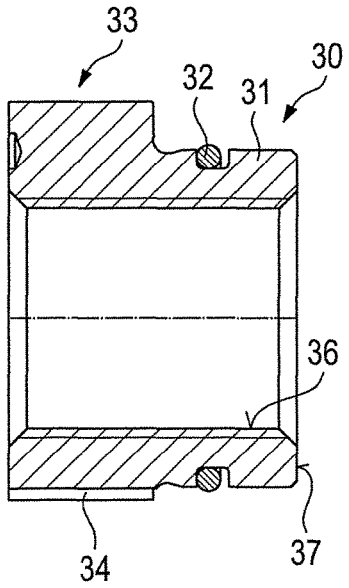
FIG. 7 is a line of section indicated VII-VII in FIG. 6.

Via the thread 19, the chisel can be screwed to the nut 30 shown in FIGS. 4 to 7. As these drawings show, the nut 30 has a sealing portion 31 in the form of a cylindrical attachment. In the outer periphery of the sealing portion 31 there is formed a groove which can clearly be seen in FIG. 7. This groove serves to receive a seal 32 which is constructed in this instance as an O-ring. A securing portion 33 adjoins the sealing portion 31. The securing portion 33 has blocking faces 34 which are constructed in a concave-curved manner. The blocking faces 34 merge into each other via convex transition portions 35. As shown in FIG. 6, the nut 30 has five blocking faces 34 which are arranged so as to be distributed in a uniform manner with the same angular spacing over the outer periphery of the nut 30. The thread 36 extends through the nut 30. In a state adjacent to the thread 36, the nut 30 has in the region of the sealing portion 31 a radial impact face 37.

Figure 2:
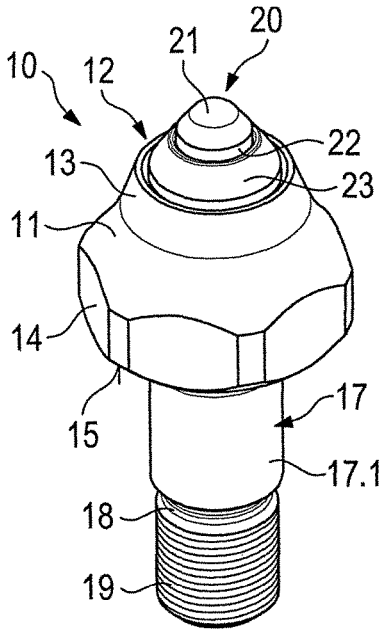
FIG. 2 is a perspective view of the chisel according to FIG. 1.

FIGS. 8 to 11 show a chisel holder 40 for receiving the chisel 10 shown in FIGS. 1 to 3. The chisel holder 40 has a base portion 41 which has a cylindrical outer contour. At the upper end thereof, the chisel holder 40 has a cylindrical attachment 42. The cylindrical attachment 42 may include, in a non-limiting example, at least one surface contour 43 such as at least one of a peripheral projection and a peripheral recess arranged on the base portion 41. In this instance, the diameter of the cylindrical attachment 42 is selected to be slightly larger than the diameter of the base portion 41. The cylindrical attachment 42 forms a counter-face 44 which is constructed so as to be curved in a spherical manner and concave. The chisel holder 40 merges in a manner adjacent to the counter-face 44 into a chisel receiving member 45 which is constructed as a bore in this instance. In a state facing away from the counter-face 44, the chisel receiving member 45 opens in a sealing portion 46 which is constructed in a bore-like manner as an inner cylinder. A seal receiving member is introduced in the wall region delimiting the sealing portion 46. The seal receiving member may, as illustrated in this instance, be constructed as a peripheral groove 46.1.

Figure 8:
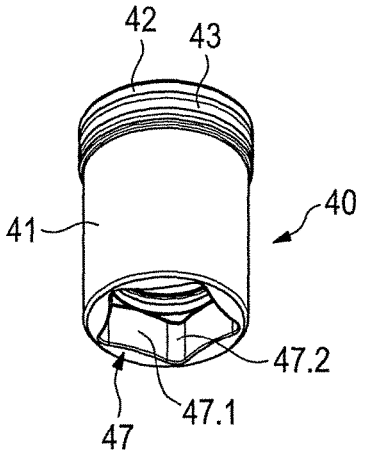
FIGS. 8 and 9 are perspective views of a chisel holder.
Figure 9:
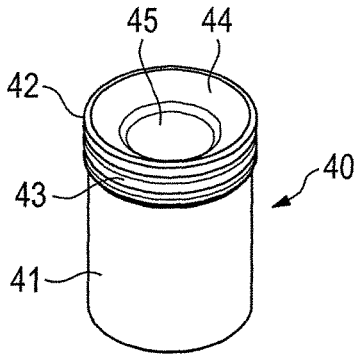
Figure 10:
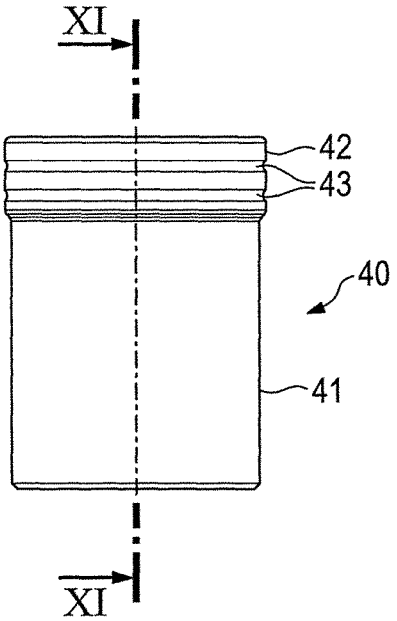
FIG. 10 is a side view of the chisel holder according to FIGS. 8 and 9.
Figure 11:
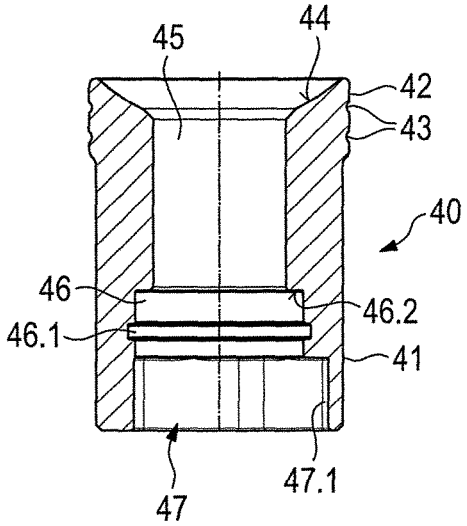
FIG. 11 shows a line of section indicated XI-XI in FIG. 10.

The chisel holder 40 has at the end thereof facing away from the cylindrical attachment 42 a holder receiving member 47. FIGS. 8 and 11 allow the structure of the holder receiving member 47 to be seen more clearly. As can be seen from these illustrations, the holder receiving member 47 is constructed as an internal receiving member in the chisel holder 40. It is delimited by five retention faces 47.1 which are curved in a convex manner. The retention faces 47.1 merge into each other via concave transition portions 47.2. The curvature of the retention faces 47.1 and the transition portions 47.2 is constructed to be adapted to the curvature of the blocking faces 34 and the transition portions 35 of the nut 30. Accordingly, the nut 30 can be guided from the rear end of the chisel holder 40 with the sealing portion 31 through the region of the holder receiving member 47 and pushed into the region of the sealing portion 46. The insertion movement of the nut 30 is blocked by means of the impact face 37 which comes to rest on a stop 46.2 of the sealing portion 46. In this assembly state, the seal 32 engages in the groove 46.1 of the sealing portion 46 so that the transition region between the outer contour of the nut 30 and the inner contour of the sealing portion 46 is sealed. The blocking faces 34 are arranged opposite the retention faces 47.1. The transition portions 35 and 47.2 are also opposite each other. In this manner, a non-rotatable arrangement of the nut 30 in the holder receiving member 47 is achieved. Since the seal 32 is retained in a manner clamped between the nut 30 and the chisel holder 40, the nut 30 is retained in a non-releasable manner.

Figure 12:
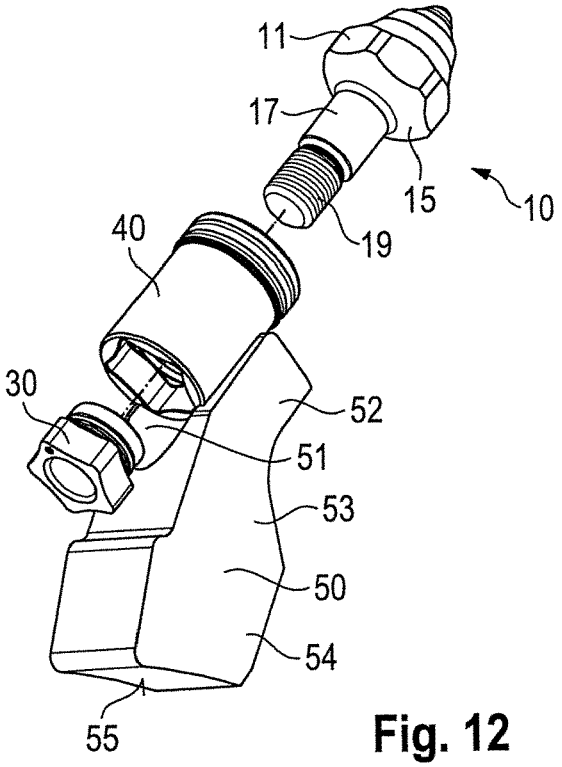
FIG. 12 is an exploded view of a chisel holder changing system.

FIG. 12 is an exploded view of a chisel holder changing system in which the chisel holder 40 is secured in a suitable manner to a lower portion 50, for example, welded. The lower portion 50 has for this purpose a securing portion 51 which in accordance with the cylindrical contour of the base portion 41 of the chisel holder 40 has a concave recess. The securing portion 51 is formed by a carrier portion 52 of the lower portion 50. The carrier portion 52 is formed integrally on a base portion 54 by means of a transition portion 53. The base portion 54 has a lower support face 55. With the support face 55, the chisel holder 40 can be placed on the outer face of a cutting roller pipe and can be secured thereto in a suitable manner, for example, welded.

Figure 13:
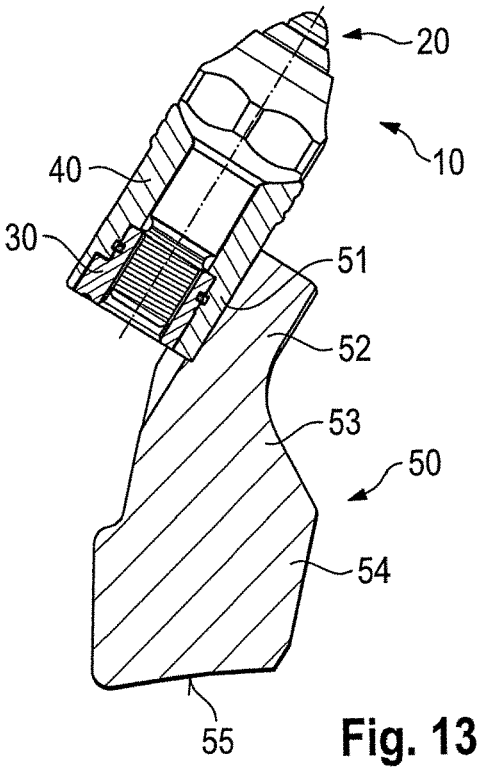
FIG. 13 is a side view and sectioned view of the chisel holder changing system according to FIG. 12.

FIG. 13 shows the above-described assembly position of the nut 30 in the holder receiving member 47. The chisel 10 can be inserted with the chisel shaft 17 thereof past the counter-face 44 into the chisel receiving member 45. In this instance, the expanding counter-face 44 facilitates the introduction movement of the chisel 10. When the thread 19 of the chisel 10 strikes the nut 30, the chisel 10 can be screwed with the thread 19 thereof into the thread 36 of the nut 30. This screwing-in movement can first be carried out by hand until the support face 15 comes to rest on the counter-face 44. Subsequently, a suitable tool can be placed on the tool receiving member 14. The chisel 10 can then be rotated with the tool and, in this instance, the threaded connection between the thread 19 and the thread 36 can then be tensioned. In order to ensure reliable fixing of the chisel 10 during the processing operations which are intended to be carried out, a high tightening torque has to be selected. In this instance, the support faces 15 and the counter-face 44 press each other. As a result of this pressing action, a seal between the chisel head 11 and the counter-face 44 is brought about in such a manner that no contamination can be introduced. Via the high torque, the expansion portion 17.1 of the chisel shaft 17 is resiliently deformed. This resilient deformation portion, in the event of loads acting on the chisel tip 20 in an impact-like manner, prevents the threaded connection between the nut 30 and the chisel shaft 17 from being able to be released. The selected geometry of the concave blocking faces 34 and the convex retention faces 47.1 enable increased force transmission regions with respect to conventional, elongate surface portions, as are conventional with nuts. Of course, the retention faces 47.1 may also be curved in a concave manner and the blocking faces 34 may accordingly be curved in a convex manner.

The convex/concave pairings selected prevent for the selected high tightening torques a plastic deformation of the blocking faces 34 or the retention faces 47.1 from being able to be produced. Consequently, in particular the holder receiving member 47 remains in the desired form and during the chisel change a new nut 30 can be inserted in a reproducible manner.

During the tool engagement, the chisel tip 20 strikes the substrate which is intended to be cut and cuts into it. In this instance, the material cut slides off the chisel tip 20. As a result of the large forces present in the region of the chisel tip 20, a great abrasive attack is brought about in this instance. This attack is taken into account by the structure of the chisel 10 with the connection portion 23, which comprises hard material, for example, hard metal. After the material removed has passed the connection portion 23, it reaches the region of the discharge face 13. It has then already lost a large proportion of its abrasive nature and can be safely guided further by the discharge face 13. In this instance, it is guided radially outward from the discharge face 13 and discharged from the tool receiving member 14 and the chisel holder 40 so that where possible it is not subjected to wear or is subjected only to slight wear.

Since the chisel 10 cannot rotate, it is first worn away at one side. This is permissible up to a specific wear limit. Then, the chisel 10 is released by means of the appropriate tool which engages on the tool receiving member 14. Subsequently, the nut 30 can be pulled from the holder receiving member 47 and inserted therein again in a rotated state. As a result of this rotation, the thread intake in the thread 36 is also arranged in a rotated position with respect to the chisel holder 40. When the same chisel 10 is again screwed to the nut 30, wherein the same tightening torque is again preferably intended to be selected, then the chisel head 11, and consequently the chisel tip 20 opposite the chisel holder 40, moves into abutment in a correspondingly rotated position. The processing side of the chisel 10 is then formed by a non-worn chisel tip location.

In the present embodiment, 5 blocking faces 34 which are arranged in a state distributed in a uniform manner with respect to each other are provided on the nut 30. Accordingly, the chisel 10 may also be secured at five mutually rotated locations to the chisel holder 40. It has been found that such an arrangement is particularly advantageous when the chisel 10 is used for the purpose of fine-milling of road surfaces. When rotated by the extent of a blocking face 34, the chisel 10 can then be worn in a manner optimized in terms of wear, wherein at the same time a high surface quality of the milled road surface is retained. When six blocking faces are used, optimized use of the chisel tip 20 in terms of wear is not achieved, as is possible with 5 blocking faces. When four blocking faces are used, there is an excessively high variance in the surface quality when the chisel tip 20 is intended to be used completely. Furthermore, when 5 blocking faces are used, that is to say, an uneven number of blocking faces 34, it is also possible to operate in such a manner that the chisel 10 is always rotated to the extent of two blocking faces 34. In this manner, a continuous uniform wear of the chisel for the purpose of high surface qualities of the milled surface can be achieved.

Figure 14:
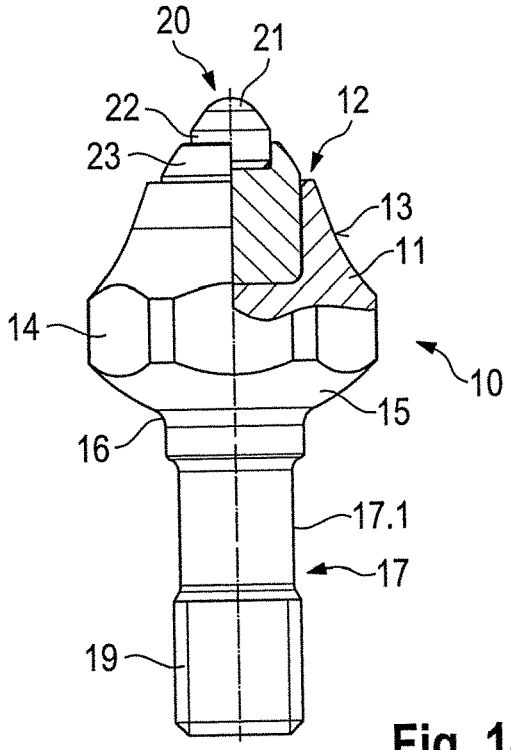
FIG. 14 is a side view of a chisel.

FIG. 14 shows another construction variant of a chisel 10. This chisel is constructed in an identical manner to the chisel 10 according to FIGS. 1 to 3 with the exception of the structure of the chisel shaft 17. Reference may therefore be made to the corresponding statements above. Furthermore, the nut 30 according to FIGS. 4 to 7 can be screwed to the thread 19 of the chisel 10, and it can accordingly be fitted in the chisel holder 40 according to FIGS. 8 to 11.

The chisel shaft 17 of the chisel 10 according to FIG. 14 has an expansion portion 17.1 which is constructed in the form of a cross-section reduction in order to achieve improved expansion behavior.

Figure 15:
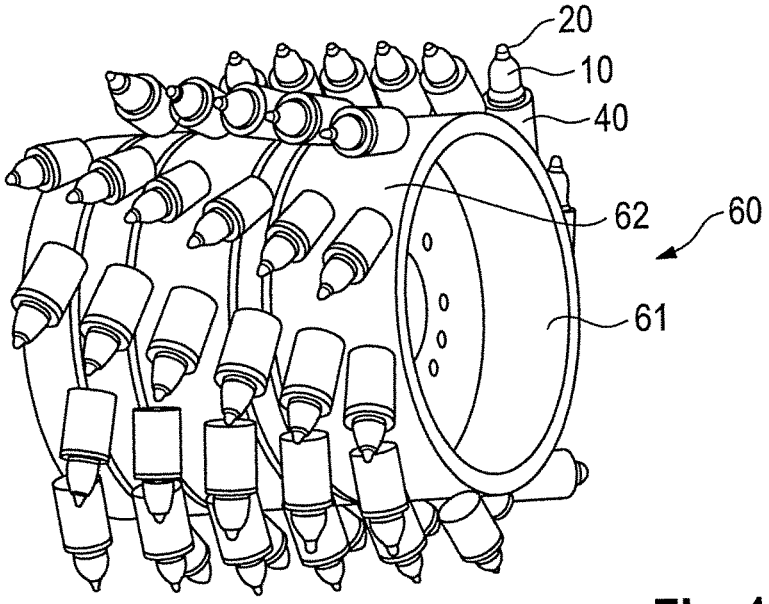
FIG. 15 is a perspective view of a milling roller of a road milling machine.

FIG. 15 shows a milling roller 60 which has a milling roller pipe 61. A large number of chisel holders 40 according to FIGS. 8 to 11 are directly secured, for example, welded, to the surface 62 of the milling roller pipe 60. The chisel holders carry the chisels 10, for example, according to FIGS. 1 to 3. As described above, the chisel holder changing systems may accordingly also be fitted in accordance, for example, with FIGS. 12 and 13 with the milling roller pipe 61. To this end, the lower portions 50 are placed with the support faces 55 thereof on the surface 62 and welded to the milling roller pipe 60.

Figure 16:
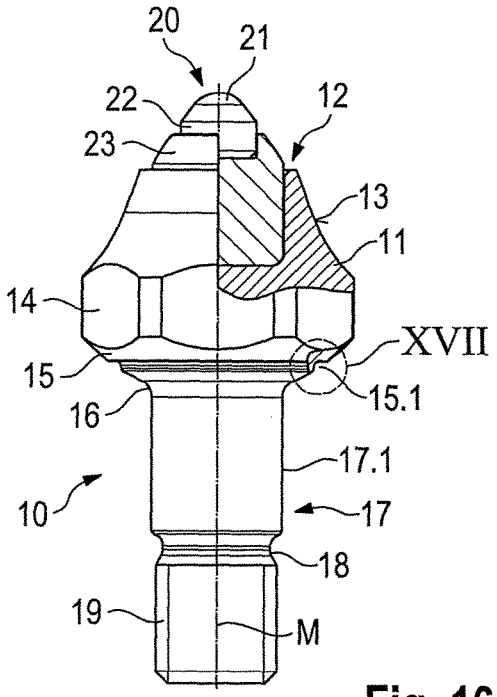
FIG. 16 is a side view and partially sectioned view of a chisel.
Figure 17:
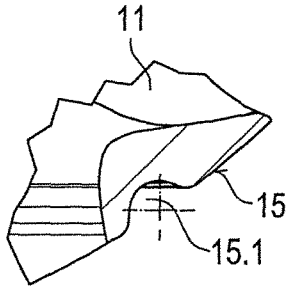
FIG. 17 shows a detail indicated in FIG. 16.
Figure 18:
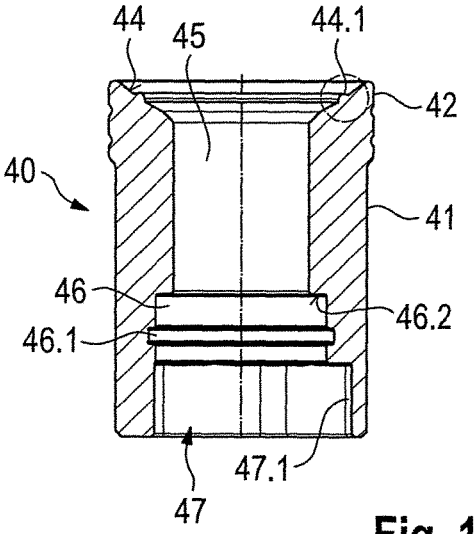
FIG. 18 is a sectioned view of a chisel holder.
Figure 19:
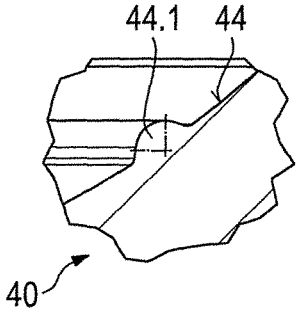
FIG. 19 is a section detail taken from FIG. 18, FIGS. 20 and 21 show another alternative construction of a chisel.

FIGS. 16 to 19 show an alternative construction of the invention to FIG. 1 to 13 or 14, wherein the chisel 10 and the chisel holder 40 are slightly modified. In order to prevent repetition, reference may therefore be made to the above statements and only the differences will be discussed below. As can be seen in FIGS. 16 and 17, in the region of the support face 15 a peripheral recess 15.1 is formed in a groove-like manner. It extends concentrically about the chisel axis M. FIGS. 18 and 19 show the chisel holder 40 which in the region of the counter-face 44 has a peripheral projection 44.1. It is constructed in a bead-like manner and also extends concentrically about the longitudinal center axis of the chisel holder 40. The positioning of the projection 44.1 is selected in such a manner that, in the assembled state of the chisel 40, it engages in the recess 15.1. In this manner, a labyrinth-like seal is formed in the region of the support face 15/counter-face 44, and impedes the introduction of dirt into the region of the chisel receiving member 45. Furthermore, the support face 15 is interrupted with the recess 15.1 so that reliable surface contact with respect to the counter-face 44 is always ensured, even with production-related deviations from the ideal shape.

In place of the projection 44.1, it is also possible to use a ring, for example, a sealing ring, in particular a commercially available O-ring or a copper ring or a similar metal ring. This may be laid in a peripheral groove of the chisel holder 40 in the region of the counter-face 44. With the region thereof which protrudes over the counter-face 44, this sealing ring then engages in the recess 15.1.

Figure 20:
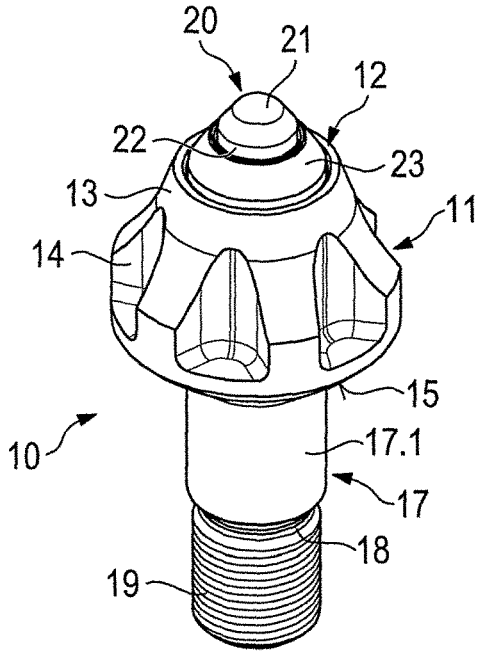
Figure 21:
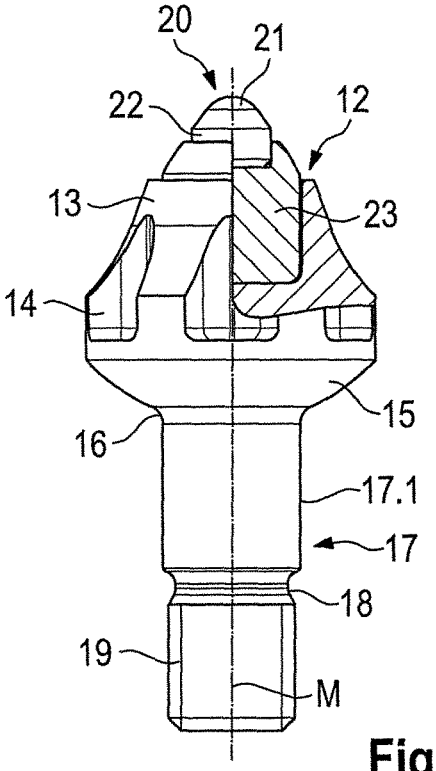

FIGS. 20 and 21 show another embodiment of a chisel 10. This chisel is constructed in accordance with the chisel 10 according to FIGS. 1 to 3, for which reason, in order to prevent repetition, only the differences are intended to be discussed below. The chisel head 11 is provided with a plurality of tool receiving members 14 on an outer periphery. These may be formed as recesses in the outer contour of the chisel head 11. The recesses are open in a radially outward direction and in an axially upward direction. Consequently, a tool can be readily fitted from the chisel tip 20. Furthermore, the tool receiving members 14 cannot become clogged with waste material or are easy to clean where applicable.

FIGS. 22 to 27 show various embodiments of chisel holder changing systems, in which the above-described chisels 10 can be used together with the nut 30 according to FIGS. 4 to 7. In these drawings, for the identification of identical or equivalent components, the same reference numerals as above are used. Reference may therefore be made in full to the statements above.

Figure 22:
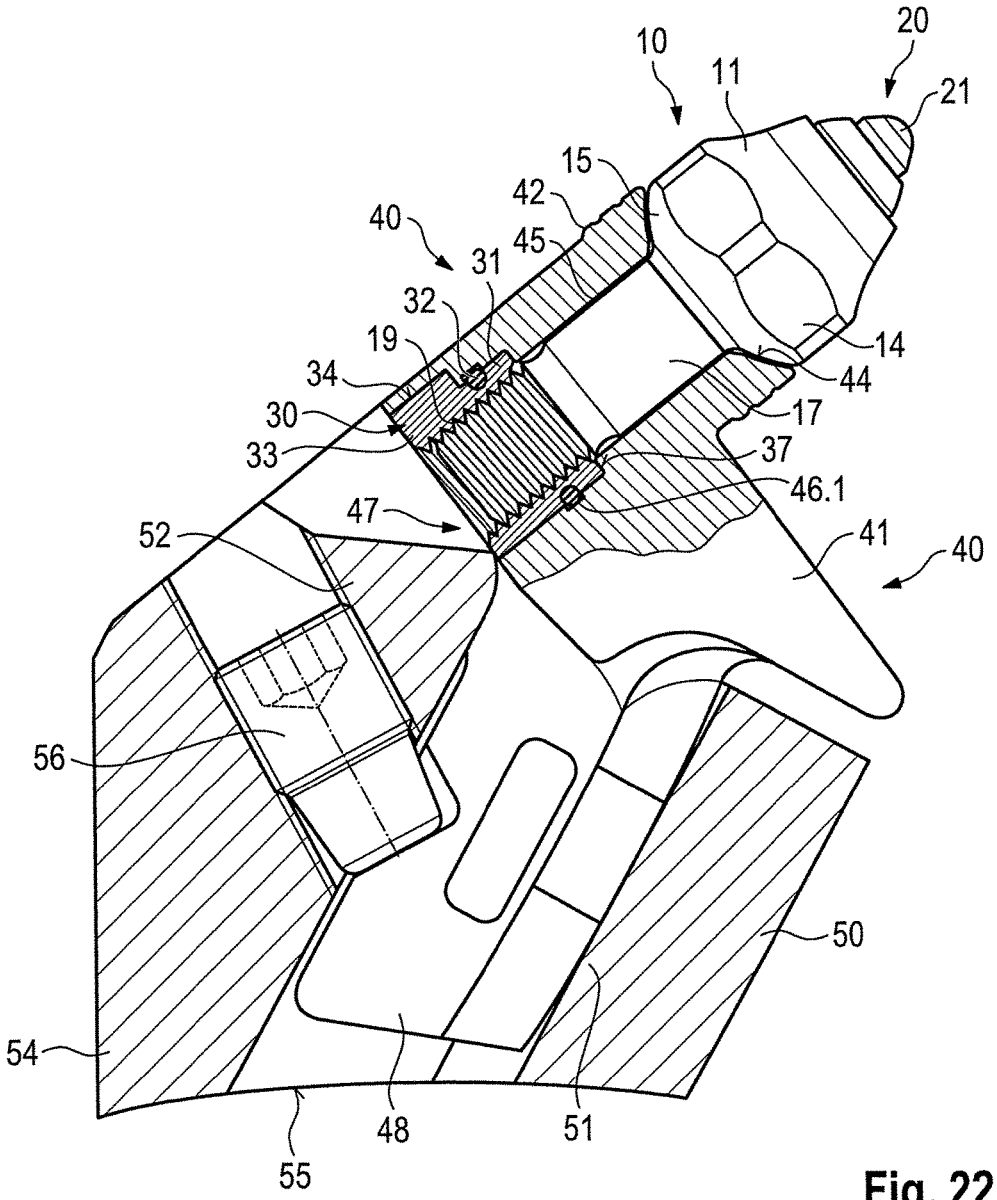
FIG. 22 is a section through a chisel holder changing system.

FIG. 22 shows a tool holder changing system having a tool holder 40, which carries at a base portion 41 an integrally formed plug type attachment 48. A cylindrical attachment 42 is further formed on the base portion 41. In the region of the cylindrical attachment 42, a counter-face 44 corresponding to the counter-face 44 is again constructed in accordance with the chisel holder 40 according to FIGS. 8 to 11. In the base portion 41 and the cylindrical attachment 42, there is formed a chisel receiving member 45 which terminates in a sealing portion 46. The sealing portion 46 is again adjoined by the holder receiving member 47, in which the nut 30 according to FIGS. 4 to 7 is inserted. In this instance, the nut 30 again has a securing portion 33 with blocking faces 34. The blocking faces 34 cooperate with retention faces 47.1 of the chisel holder 40 in order to secure the nut 30 in a rotationally secure manner. The nut 30 is again sealed with the sealing portion 31 thereof and the seal 32 on the sealing portion 46 of the chisel holder 40.

As can further be seen in FIG. 22, the chisel 10 with the thread 19 is screwed into the thread 36 of the nut 30 until the impact face 37 strikes the chisel holder 40.

The chisel holder 40 is inserted with the plug type attachment 48 thereof into a plug type receiving member of a lower portion 50. The chisel holder 40 is supported with respect to the lower portion 50 and is retained in the lower portion 50 with a pressure screw 56 which acts on the plug type attachment 48.

Figure 23:
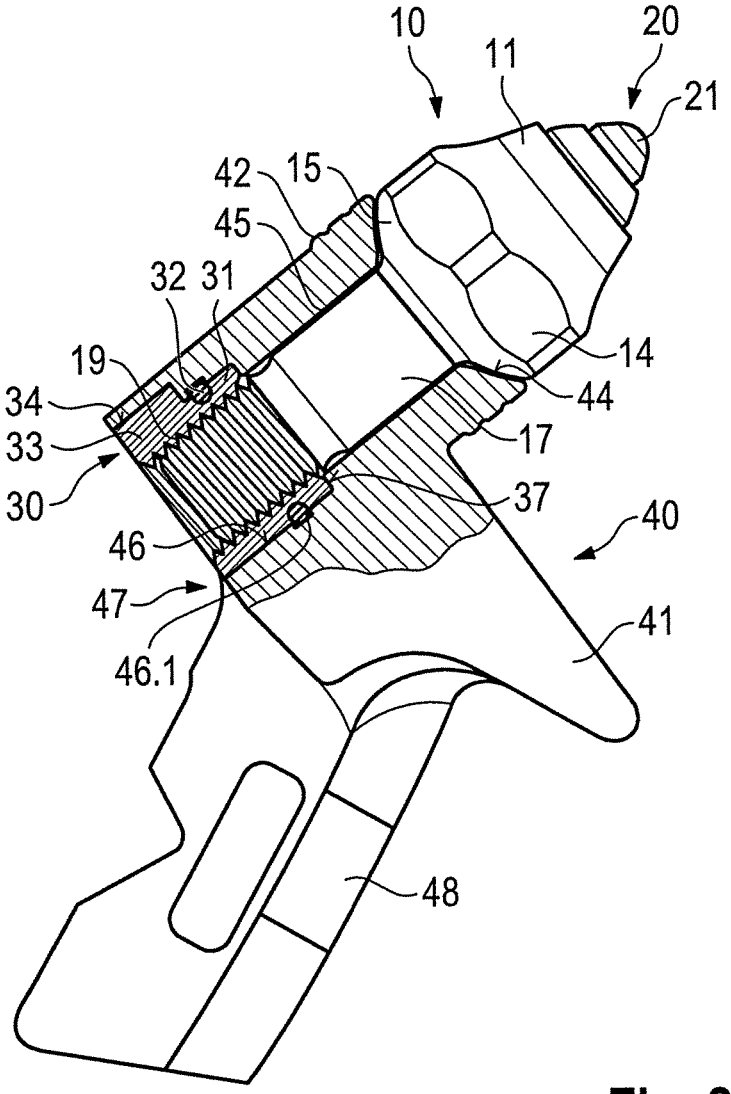
FIG. 23 is a side view and partially sectioned view of a chisel holder according to FIG. 22, FIGS. 24 to 27 are side views of different versions of chisel holder changing systems.

FIG. 23 shows the combination of the chisel holder 40 with the chisel 10, as described above with reference to FIG. 22.

Figure 24:
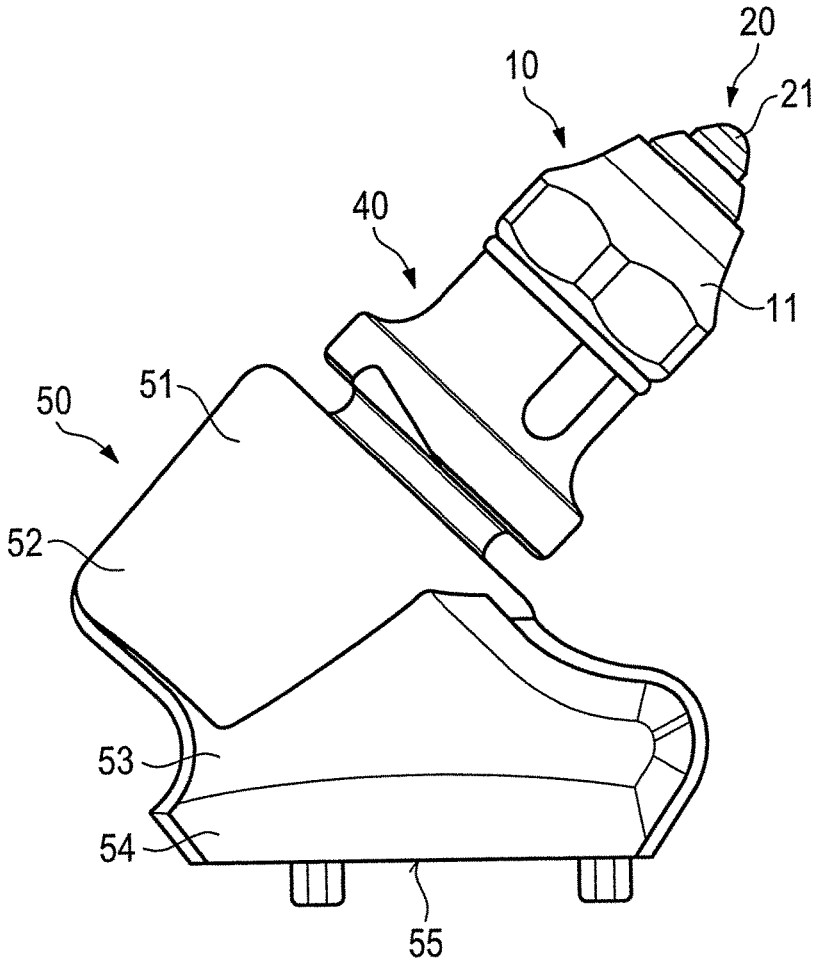

FIG. 24 shows another chisel holder changing system. Accordingly, there is again used a chisel holder 40 which receives the chisel 10 and the nut 30 in the manner described above. The chisel holder 40 is retained in a lower portion 50 with a plug type attachment which cannot be seen in FIG. 24.

Figure 25:
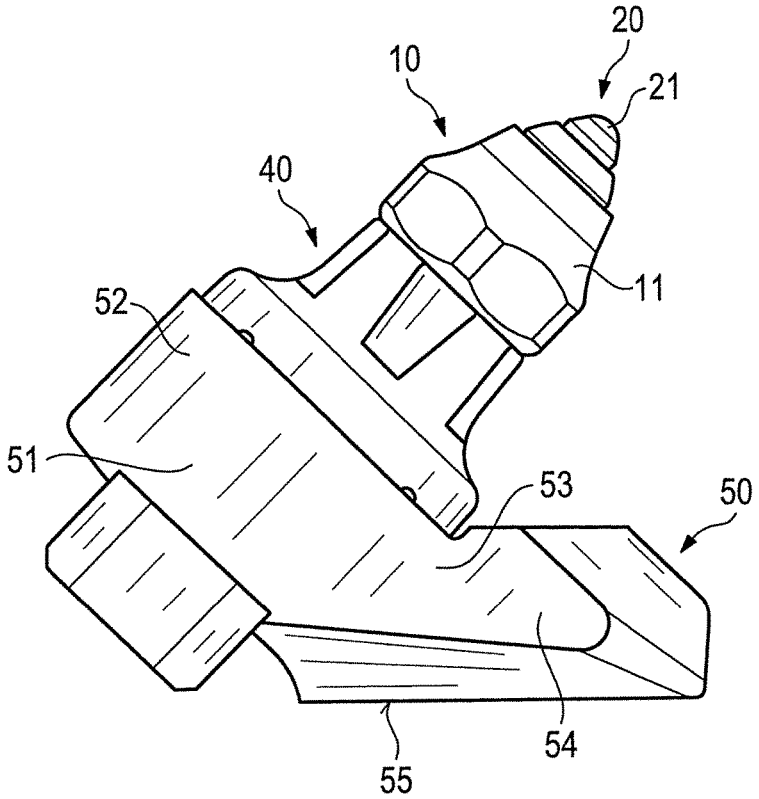

FIG. 25 shows a construction variant of a chisel holder changing system having a chisel holder 40 and a lower portion 50.

Figure 26:
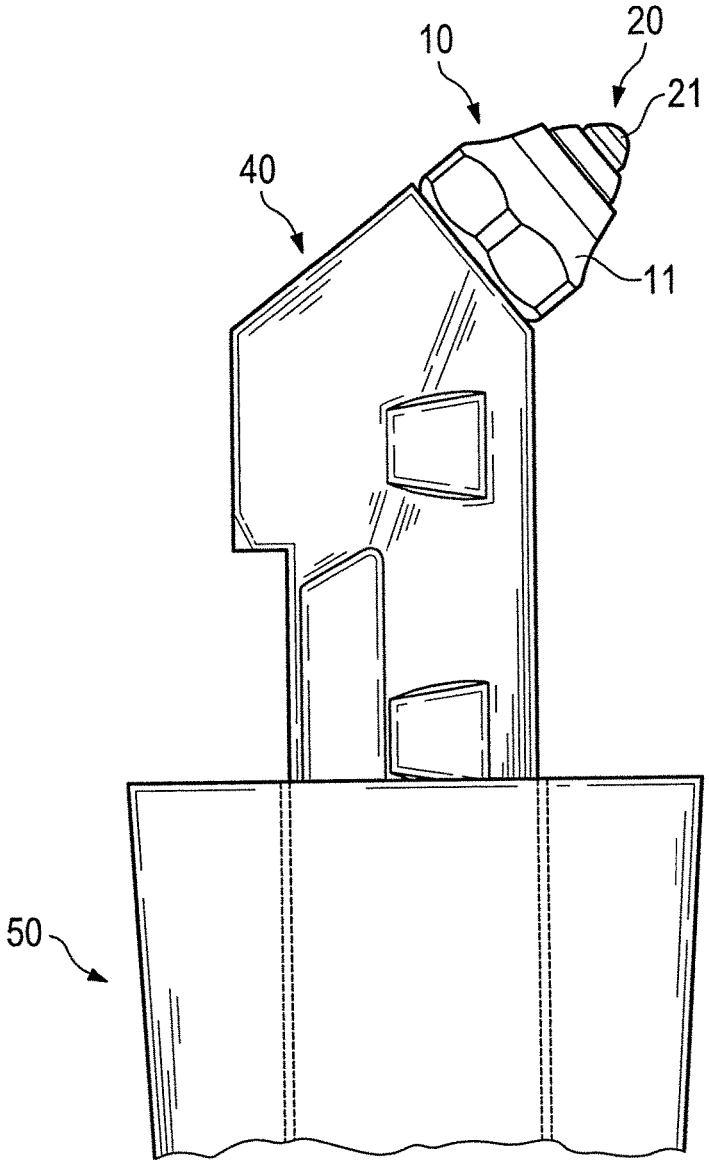

FIG. 26 shows another construction variant of a chisel holder changing system having a chisel holder 40 and a lower portion 50 which receives the chisel holder 40.

Figure 27:
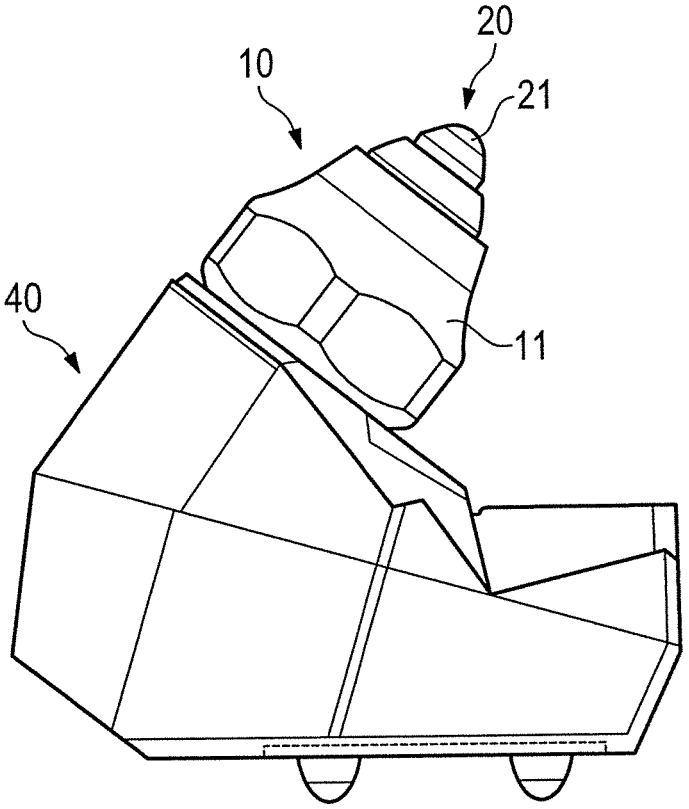

FIG. 27 discloses a tool system having a chisel holder 40, in which the chisel 10 is inserted. The chisel holder 40 can be placed directly on the surface 62 of a milling roller pipe 60 and secured thereto, for example, welded.

The invention claimed is:

1. A chisel for a ground processing machine, the chisel comprising:

a chisel head including a curved support face integrally formed on the chisel head, the curved support face including at least one of a spherical and an ellipsoid curve, the chisel head further including a tool receiving member, the tool receiving member including at least one of an outer polygonal member and a recess formed in the chisel head;

a chisel shaft connected to the chisel head such that the support face faces the chisel shaft, the chisel shaft including a thread portion opposite the chisel head, the thread portion including a thread, the chisel shaft having a longitudinal center axis; and a chisel tip carried by the chisel head, the chisel tip including a hard material aligned along the longitudinal center axis.

2. The chisel of claim 1, wherein the tool receiving member is the outer polygonal member.

3. The chisel of claim 2, wherein the outer polygonal member is an outer hexagonal member.

4. The chisel of claim 1, wherein the tool receiving member is the at least one recess formed in the chisel head.

5. The chisel of claim 1, the chisel head further comprising a discharge face arranged between the chisel tip and the tool receiving member.

6. The chisel of claim 5, the chisel head further comprising a chisel tip receiver opposite the chisel shaft.

7. The chisel of claim 1, the chisel tip including an operating portion which includes at least one of diamond, polycrystalline diamond, natural diamond, synthetic diamond, vapor-deposition diamond, silicon-bonded diamond, cobalt-bonded diamond, thermally stable diamond, cubic boron nitride, a diamond-infiltrated material, a diamond-tipped matrix, a diamond-impregnated carbide, and a material having a comparable hardness to diamond.

8. The chisel of claim 1, the chisel shaft including a reduced diameter expansion portion between the thread portion and the chisel head.

9. The chisel of claim 8, wherein the expansion portion extends at least 20 mm and a maximum of 50 mm along a longitudinal center axis of the chisel shaft.

10. The chisel of claim 1, in combination with:

a nut retained on the thread portion;

wherein the chisel further includes a transition region located between the chisel head and the chisel shaft, the transition region including a transition diameter;

the chisel shaft including a constant shaft cross-section from the chisel head toward the thread portion; and the thread portion including a thread portion diameter substantially similar to the transition diameter.

11. The combination of claim 10, the nut including a nut seal portion.

12. The combination of claim 10, the nut including a securing portion having blocking faces on a periphery of the nut.

13. The combination of claim 12, the blocking faces including curved face portions.

14. The combination of claim 13, wherein each of the blocking faces merge into an adjacent blocking face in a curved transition.

15. The chisel of claim 1, the chisel head including at least one of a peripheral projection and a peripheral recess arranged on the support face.

16. The chisel of claim 15, wherein the at least one of a peripheral projection and a peripheral recess extends concentrically relative to the chisel shaft.

17. The chisel of claim 1, in combination with:

a holder configured to receive the chisel shaft, the holder including a chisel head receiver diameter; and wherein the chisel head includes a maximum chisel head diameter greater than the chisel head receiver diameter.

18. A chisel for a around processing machine, the chisel comprising:

a chisel head including a curved support face integrally formed on the chisel head;

a chisel shaft connected to the chisel head such that the support face faces the chisel shaft, the chisel shaft including a thread portion opposite the chisel head, the thread portion including a thread, the chisel shaft having a longitudinal center axis; and a chisel tip carried by the chisel head, the chisel tip including a hard material aligned along the longitudinal center axis;

wherein the chisel shaft includes a reduced diameter expansion portion between the thread portion and the chisel head;

wherein the expansion portion extends at least 20 mm and a maximum of 50 mm along a longitudinal center axis of the chisel shaft; and wherein the expansion portion includes a uniform circular cross-section.

19. The chisel of claim 18, the curved support face including at least one of a spherical and an ellipsoid curve.

* * * * *